US007350526B2

(12) United States Patent
McCabe et al.

(10) Patent No.: US 7,350,526 B2
(45) Date of Patent: Apr. 1, 2008

(54) DISPOSABLE TOOTHBRUSH ASSEMBLY

(76) Inventors: Kathleen McCabe, 631 E. Palm Ave., Apt. 1, Burbank, CA (US) 91501; Jason Thielen, 631 E. Palm Ave., Apt. 1, Burbank, CA (US) 91501

( * ) Notice: Subject to any disclaimer, the term of this patent is extended or adjusted under 35 U.S.C. 154(b) by 23 days.

(21) Appl. No.: 11/370,512

(22) Filed: Mar. 7, 2006

(65) Prior Publication Data

US 2007/0209676 A1 Sep. 13, 2007

(51) Int. Cl.
*A46B 15/00* (2006.01)

(52) U.S. Cl. ..... 132/311

(58) Field of Classification Search ..... 132/116, 132/308, 309, 311; 222/156.13, 384, 43; 401/171–182; 604/38, 220, 221, 222, 208
See application file for complete search history.

(56) References Cited

U.S. PATENT DOCUMENTS

| | | | | | |
|---|---|---|---|---|---|
| 2,199,922 | A | * | 5/1940 | McManis et al. | 132/308 |
| 2,521,928 | A | * | 9/1950 | Mauro et al. | 222/340 |
| 2,836,839 | A | * | 6/1958 | Julian | 401/181 |
| 4,377,106 | A | * | 3/1983 | Workman et al. | 92/23 |
| 5,088,850 | A | * | 2/1992 | Taichman et al. | 401/176 |
| 5,439,014 | A | | 8/1995 | Moussa | |
| 5,464,294 | A | * | 11/1995 | Chee et al. | 401/269 |
| 5,490,530 | A | | 2/1996 | Snowden | |
| 5,584,593 | A | | 12/1996 | Lafortune | |
| 5,636,933 | A | * | 6/1997 | Vizsolyi | 401/269 |
| 5,651,372 | A | * | 7/1997 | Caillouette | 600/567 |
| 5,811,061 | A | * | 9/1998 | Martinson et al. | 422/102 |
| 5,842,487 | A | | 12/1998 | Ledet | |
| 6,397,859 | B1 | | 6/2002 | Byrd | |
| 6,463,937 | B1 | | 10/2002 | Cloutier et al. | |
| 6,554,522 | B1 | | 4/2003 | Connelly et al. | |
| 6,971,381 | B2 | * | 12/2005 | Langford | 128/200.23 |

* cited by examiner

*Primary Examiner*—Robyn Doan
*Assistant Examiner*—Rachel A. Running
(74) *Attorney, Agent, or Firm*—Edwin P. Tarver; Patel & Alumit, P.C.

(57) ABSTRACT

A disposable toothbrush with a built-in toothpaste applicator mechanism, the toothbrush mainly comprising a multiplicity of bristles, a plurality of apertures located between the bristles, a hollow compartment for containing a quantity of toothpaste, a bore connecting the apertures and the hollow compartment, a flexible locking member, and a plunger with a head, a base and a stem. The head of the plunger is dimensioned to achieve a substantially gapless interface inside the hollow compartment for pushing the toothpaste into the bore and out from the apertures. The locking member is secured over the stem of plunger for preventing it from being accidentally pushed into the hollow compartment before using the toothbrush. In order to use the toothbrush, first the locking member is removed. Then the plunger is pushed into the hollow compartment to extract the toothpaste out from the plurality of apertures and on to the bristles.

4 Claims, 14 Drawing Sheets

DISPOSABLE TOOTHBRUSH ASSEMBLY

FEDERALLY SPONSORED RESEARCH

Not Applicable

CROSS-REFERENCE TO RELATED APPLICATION

None

SEQUENCE LISTING OR PROGRAM

Not Applicable

STATEMENT REGARDING COPYRIGHTED MATERIAL

Portions of the disclosure of this patent document contain material that is subject to copyright protection. The copyright owner has no objection to the facsimile reproduction by anyone of the patent document or the patent disclosure as it appears in the Patent and Trademark Office file or records, but otherwise reserves all copyright rights whatsoever.

BACKGROUND

The present invention generally relates to disposable toothbrushes, and more particularly to a disposable toothbrush with a built-in toothpaste applicator mechanism. The disposable toothbrush contains toothpaste sufficient for one use.

Disposable toothbrushes with built-in toothpaste applicator mechanisms are useful particularly while traveling, and during outdoor activities such as camping. These devices eliminate the need to carry separate tubes of toothpaste. Structures and mechanisms related to these toothbrushes, in general, comprise a cavity or a compartment for containing toothpaste, a means to dispense the toothpaste and a means to deliver the toothpaste from to the bristles of the toothbrush.

Several disposable toothbrushes have been developed the art. For example, U.S. Pat. No. 5,584,593 to Lafortune discloses a toothbrush with a hollow handle, a neck and a head. The hollow handle contains toothpaste. A compressible plastic pad is provided on the handle to facilitate squeezing. When the handle is squeezed the paste passes through a duct on to the bristles.

U.S. Pat. No. 6,554,522 to Connelly discloses a toothbrush that has toothpaste in a chamber in the head of the toothbrush. A plunger is located within the chamber. When the plunger is pushed, the toothpaste within the chamber passes onto bristles through apertures in the head. The other end of the handle of the toothbrush is curved and adapted for attachment of dental floss under tension. However, this device is different from the present invention in that it does not include a locking mechanism, which prevents the plunger from being accidentally pushed before usage.

U.S. Pat. No. 6,397,859 to Byrd discloses a disposable toothbrush that has a cavity to accommodate toothpaste. A user can get the paste onto the bristles by pushing the plunger, which is provided at the bottom end of the toothbrush and into the cavity. However, the structure of this device such as the location of the plunger and the locking mechanism is different from the present invention.

In light of the above, there is a need for a disposable toothbrush with a simplified and reliable toothpaste dispensing mechanism and an effective locking mechanism to prevent the toothpaste from being accidentally dispensed on to the bristles before usage.

Therefore, it is an object of the present invention to provide a disposable toothbrush, which includes an effective locking mechanism to prevent accidental dispensation of the toothpaste before usage.

A further object is to provide a disposable toothbrush, which contains sufficient toothpaste for one brushing.

A further object is to provide a disposable toothbrush, which includes a simplified and reliable mechanism to dispense the toothpaste on to the bristles.

Finally, it is an object of the present invention to provide a toothbrush, which is fabricated from low-cost plastic molding techniques. These and other objects of the present invention will become better understood with reference to the appended Summary, Description, and Claims.

SUMMARY

The present invention is a disposable toothbrush with a built-in toothpaste applicator mechanism. The toothbrush comprises a rectangular cross section divided into a head portion and a handle portion. The head portion comprises a multiplicity of bristles and a plurality of apertures between the bristles. The handle portion comprises a hollow compartment for containing toothpaste, a bore connecting the hollow compartment and the plurality of apertures, a plunger disposed in the hollow compartment and a locking member. Before usage, the locking member is secured over the plunger for preventing the plunger from being accidentally pushed into the hollow compartment.

In order to use the toothbrush, first the locking member is removed from the plunger. The plunger is then pushed into the hollow compartment, thereby forcing the toothpaste out of the apertures through the bore. Once the bristles have become flush with toothpaste, the toothbrush is ready for use.

FIGURES—REFERENCE NUMERALS

10 . . . Toothbrush

Figure 1A:
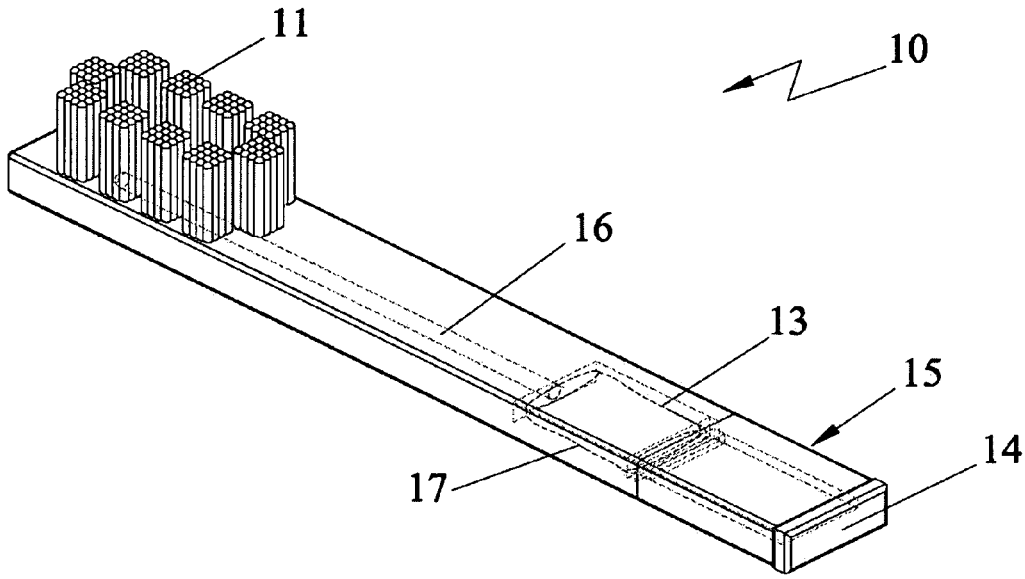
FIGS. 1A, 1B and 1C are illustrations of different views of the toothbrush in accordance with the present invention.

11 . . . Bristles
12 . . . Aperture
13 . . . Hollow Compartment
14 . . . Plunger
15 . . . Locking Member
16 . . . Bore
17 . . . Tube containing Toothpaste
18 . . . Stem of the Plunger
19 . . . Base of the Plunger
20 . . . Horizontal Panel
21 . . . Vertical Panel
22 . . . Catching Member
23 . . . Inclined Face
24 . . . Horizontal Face
25 . . . Vertical Face
26 . . . Toothpaste
27 . . . Sealed Package
28 . . . Head of the Plunger
29 . . . Opening in Hollow Compartment

DETAILED DESCRIPTION

Referring to the drawings, a preferred embodiment of a disposable toothbrush 10 is illustrated in FIGS. 1 through 9. The toothbrush 10 contains sufficient toothpaste for one brushing. The toothbrush 10 is fabricated using molding techniques and is disposable after use.

Figure 1B:
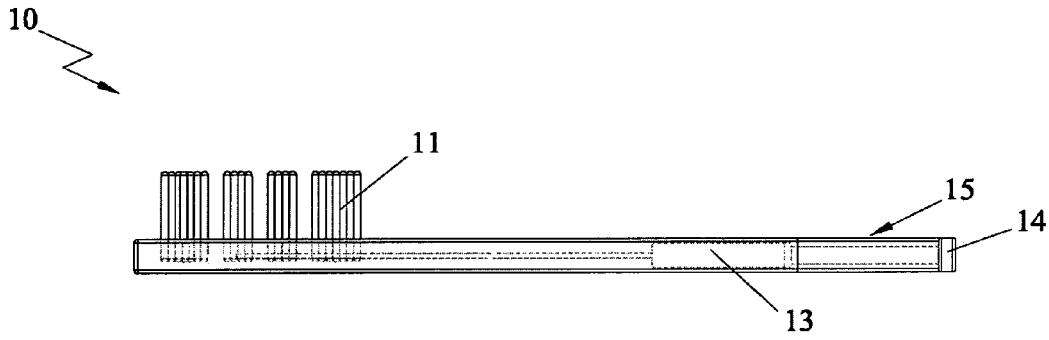
Figure 1C:
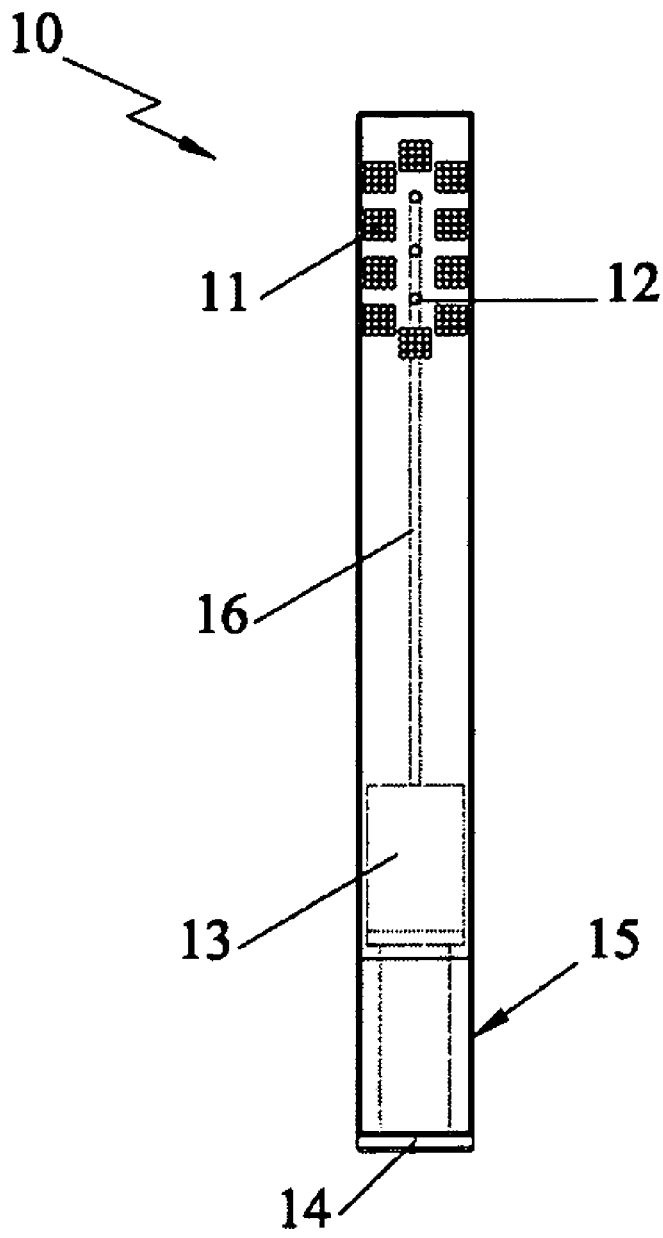
Figure 2:
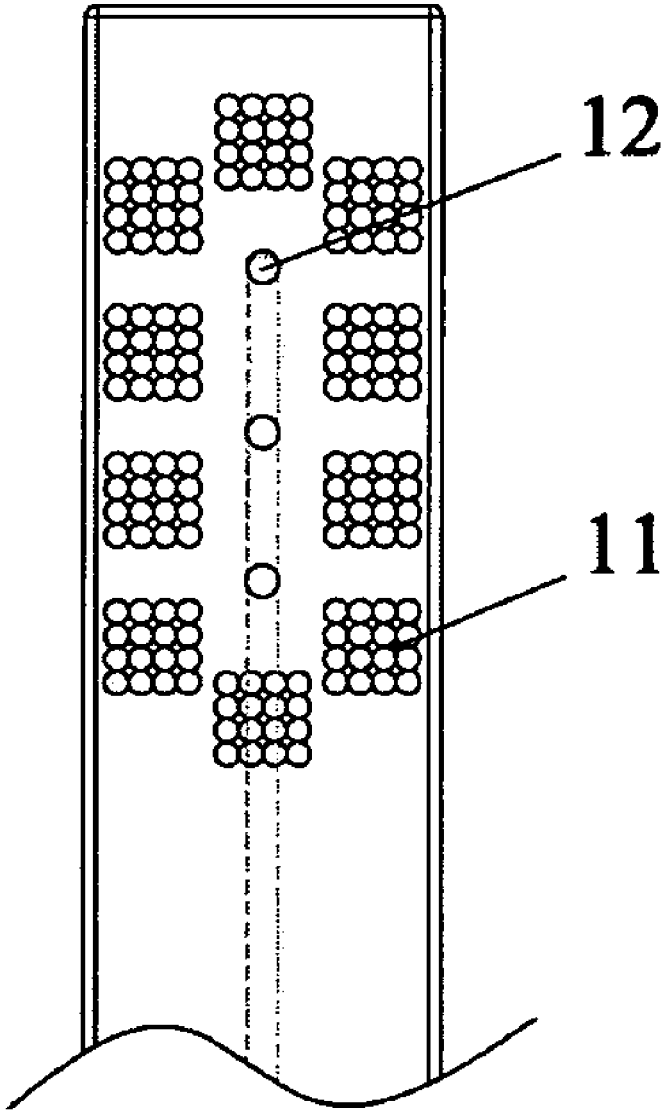
FIG. 2 is an illustration of the top view of the head portion of the toothbrush in accordance with the present invention.
Figure 3:
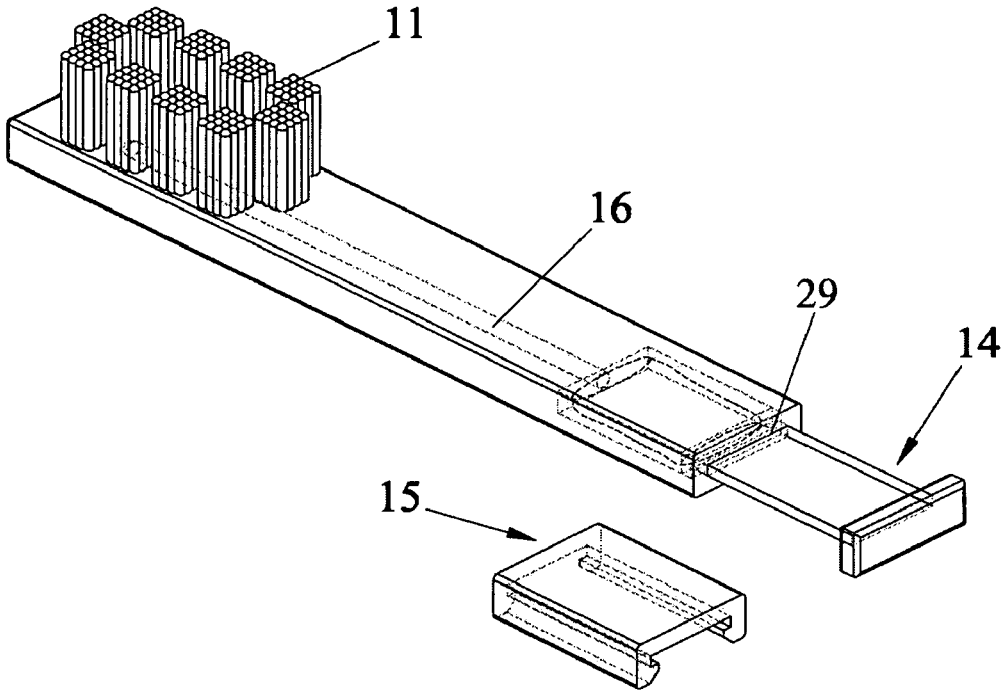
FIG. 3 is an illustration of the toothbrush with the locking member removed in accordance with the present invention.

Referring to FIGS. 1 through 3, the toothbrush 10 is of rectangular cross-section and can be divided into a head portion and a handle portion. The head portion of the toothbrush includes a multiplicity of bristles 11 disposed thereon, and a plurality of apertures 12 between the bristles 11. The handle portion of the toothbrush 10 includes a hollow compartment 13, a plunger 14, a flexible locking member 15, and a bore 16. The hollow compartment 13 is located near the bottom portion of the toothbrush 10. The hollow compartment 13 contains a predetermined quantity of toothpaste, which is in turn contained in a tube 17. The tube 17 includes an opening (not shown), which is connected to the bore 16.

The bore 16 is of circular cross section and extends along the length of the toothbrush 10. The bore 16 connects the hollow compartment 13 and the plurality of apertures 12. The bore 16 acts as a channel for conveying the toothpaste from the hollow compartment 13 to the plurality of apertures 12.

Figure 4:
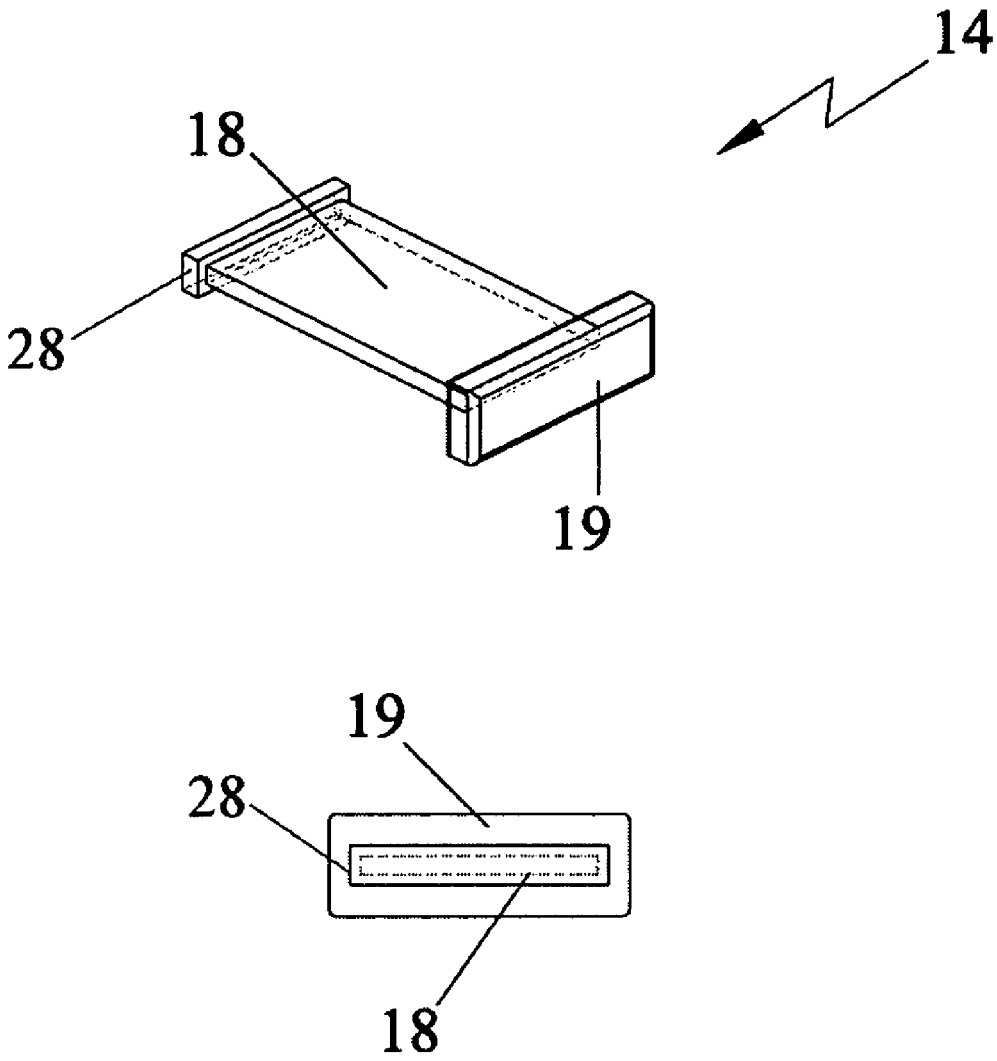
FIG. 4 is an illustration of perspective and side views of the plunger in accordance with the present invention.

Referring to FIGS. 3 and 4, the plunger 14 includes a stem 18, a head 28 and a base 19. The stem 18, head 28 and base 19 are of rectangular cross-section. The cross-sectional area of the stem 18 is less than that of the base 19 and the head 28. The dimensions of the head 28 are substantially equal to the dimensions of the hollow compartment 13, such that it can slide inside the hollow compartment 13 for pushing the toothpaste into the bore 16 and out from the plurality of apertures 12. The hollow compartment includes an opening 29 at its bottom, which is adapted to receive the stem of the plunger. The opening 29 has a dimension to prevent the head 28 of the plunger from being pulled out of the hollow compartment 13.

Figure 5:
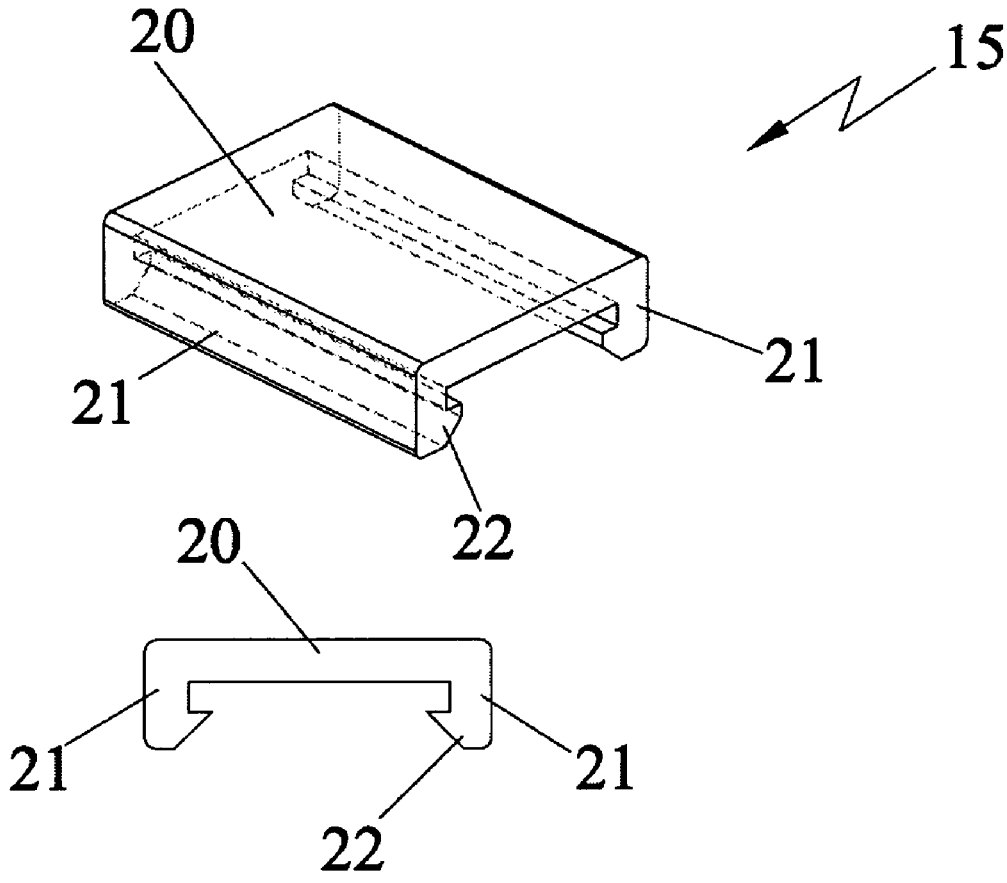
FIG. 5 is an illustration of the locking member in accordance with the present invention.

Referring to FIGS. 5 and 6, before using the toothbrush, the locking member 15 is secured by engaging it over the stem 18 in a sliding motion to prevent the movement of the plunger 14 into the hollow compartment 13. The locking member 15 includes a horizontal panel 20 and two vertical panels 21 projecting perpendicularly from two edges of the horizontal panel 20. The inner surface area formed by the horizontal and vertical panels 20 and 21 of the locking member 15 is substantially equal to the outer surface area of the stem 18 of the plunger 14. When the locking member 15 is engaged and secured over the stem 18, the inner surfaces of the horizontal and vertical panels 20 and 21 abut the stem 18.

Figure 6A:
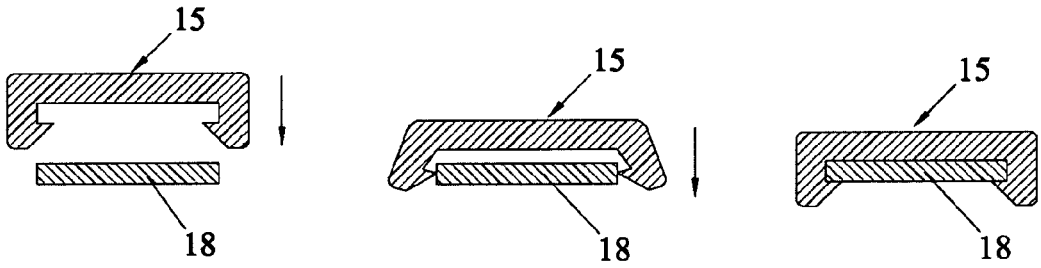
FIG. 6A is an illustration of sectional views of the locking member being slidably engaged over the stem of the plunger in accordance with the present invention.
Figure 6B:
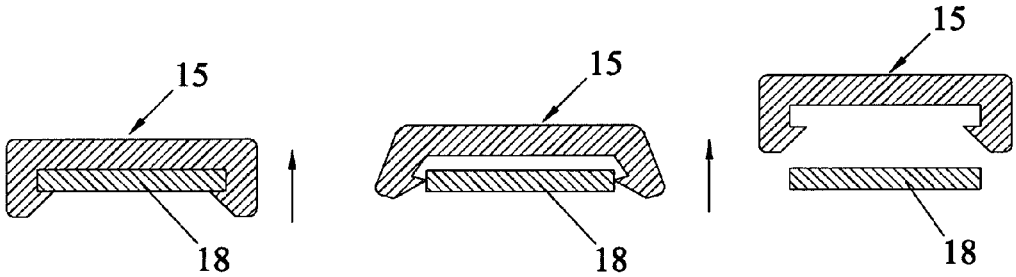
FIG. 6B is an illustration of sectional views of the locking member being slidably disengaged from the stem of the plunger in accordance with the present invention.
Figure 7:
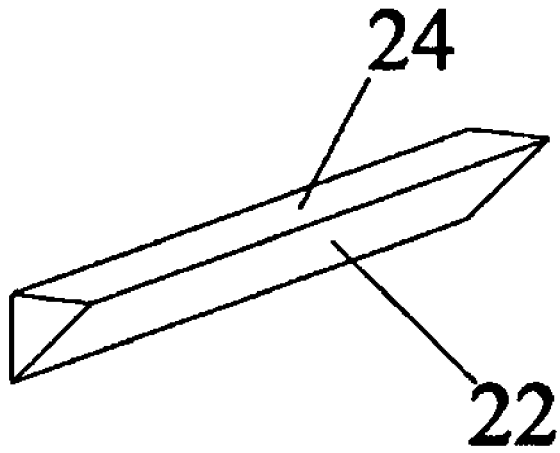
FIG. 7 is an illustration of perspective views of the catching member in accordance with the present invention.
Figure 7:
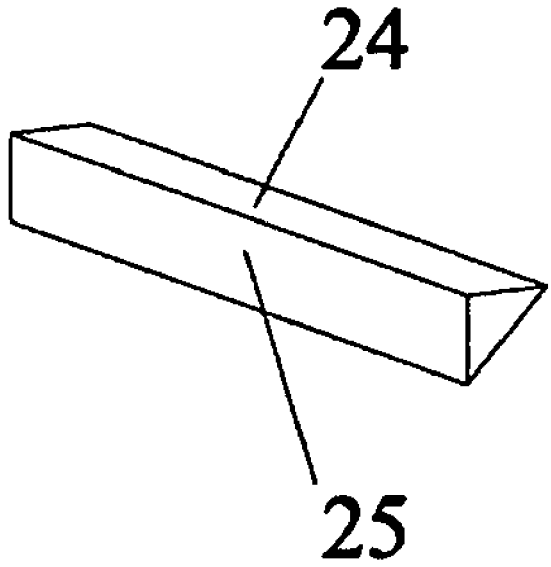

Referring to FIGS. 5 through 7, catching members 22 are disposed along the inside and free ends of the vertical panels 21, which oppose the horizontal panel 22. The catching member 22 is a projection with a right-angled triangular cross-section and comprises an inclined face 23, a horizontal face 24 and a vertical face 25. The vertical face 25 is the plane of connection to the vertical panel 21 and the horizontal face 24 is parallel to the horizontal panel 20.

The locking member 15 is made of resilient material such as plastic. The two vertical panels 21 will flex and resiliently deform while engaging or disengaging the locking member 15, as seen in FIGS. 6A and 6B. The locking member is positioned above the stem of the plunger and engaged. Once engaged, the catching members 22 will hold the locking member 15 in place. In order to disengage the locking member, the vertical panels are forced apart manually and the locking member is pulled out.

Figure 8A:
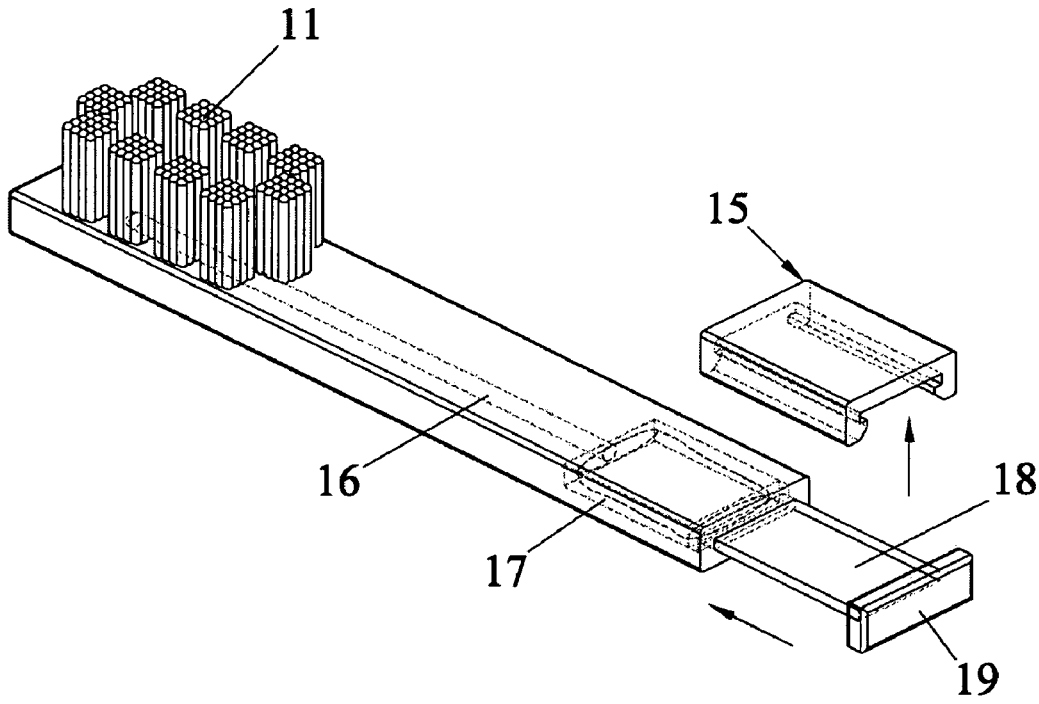
FIG. 8 is an illustration of the usage of the toothbrush in accordance with the present invention.
Figure 8B:
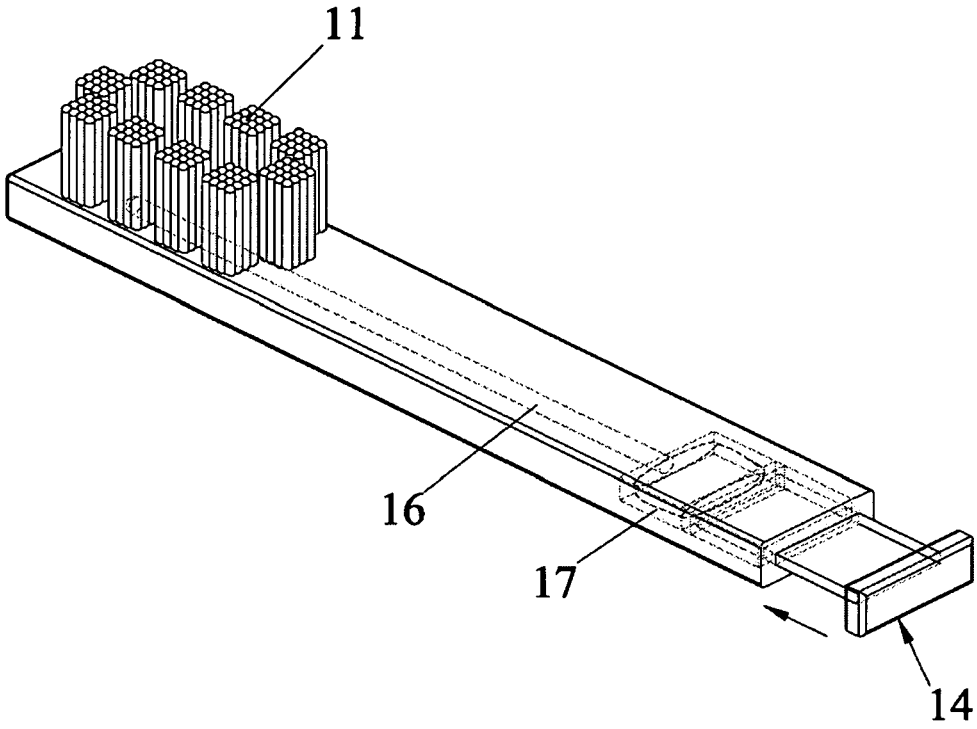
Figure 8C:
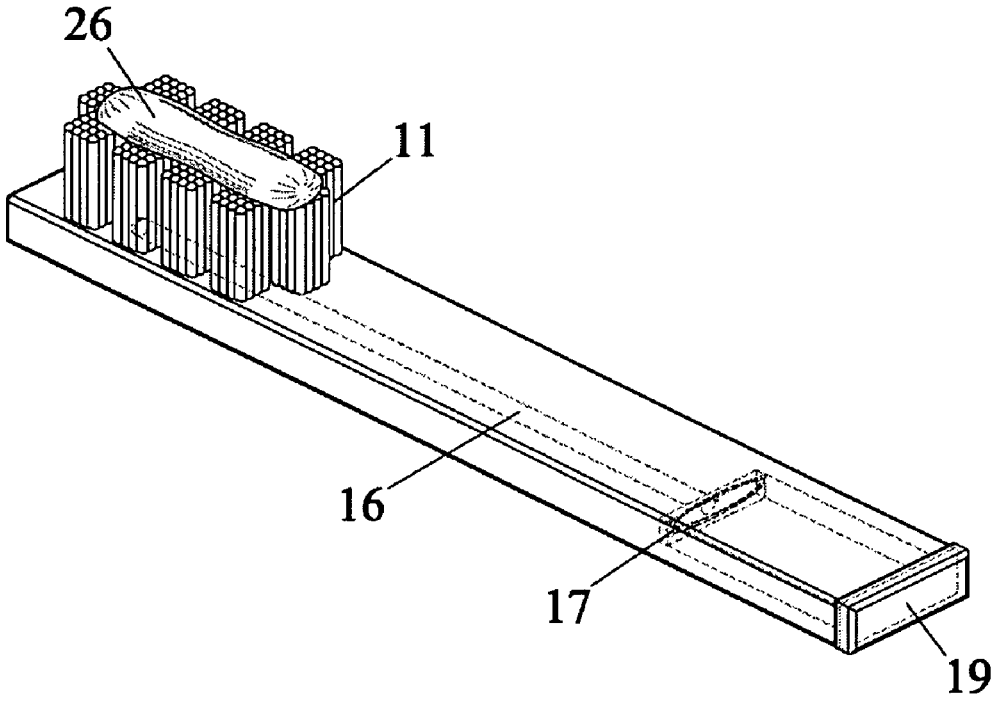

Referring to FIGS. 8A through 8C, in order to use the toothbrush 10, first the locking member 15 is removed. The plunger 14 is then pushed into the hollow compartment 13, and simultaneously the toothpaste in the hollow compartment 13 is pushed through the bore 16 and out from the plurality of apertures 12 where it will mingle with the bristles 11. When the plunger 14 is fully pushed, the base 19 of the plunger 14 gets locked to the bottom of the hollow compartment 13 by the suction created in the hollow compartment. At this stage the bristles 11 will become flush with toothpaste 26, as seen in 8C.

Figure 9:
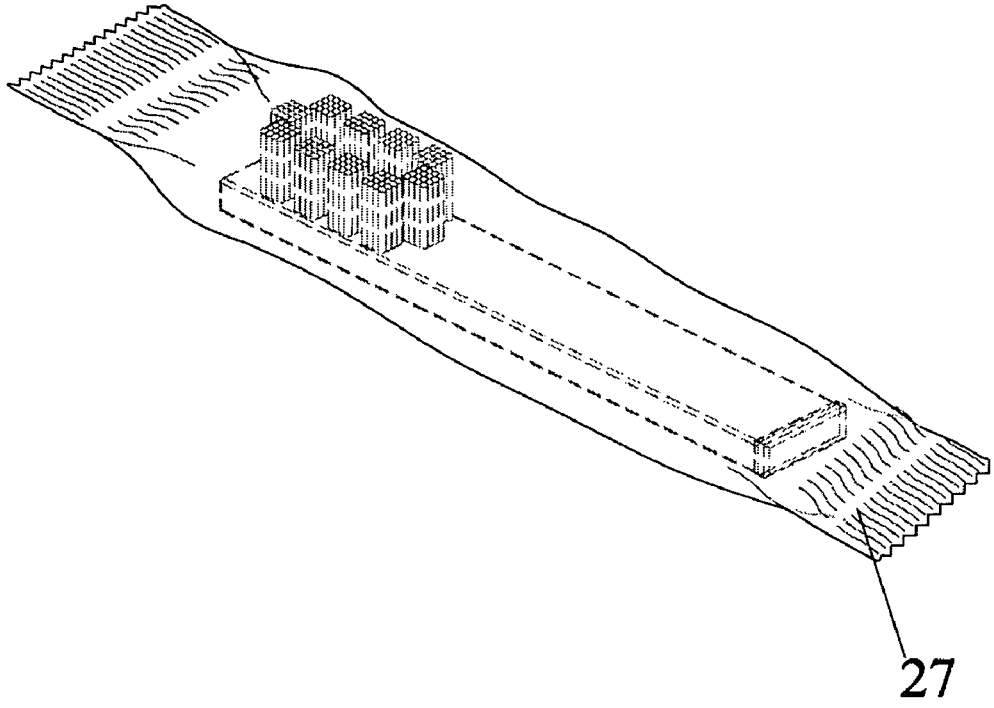
FIG. 9 is an illustration of the toothbrush sealed in a package.

Referring to FIG. 9, the toothbrush 10 is hermetically sealed to preserve sterility for hygiene. The sealed package 27 is inflated to cushion the toothbrush 10 and protect the bristles 11 from being crushed.

All features disclosed in this specification, including any accompanying claims, abstract, and drawings, may be replaced by alternative features serving the same, equivalent or similar purpose, unless expressly stated otherwise. Thus, unless expressly stated otherwise, each feature disclosed is one example only of a generic series of equivalent or similar features.

Any element in a claim that does not explicitly state "means for" performing a specified function, or "step for" performing a specific function, is not to be interpreted as a "means" or "step" clause as specified in 35 U.S.C. §112, paragraph 6. In particular, the use of "step of" in the claims herein is not intended to invoke the provisions of 35 U.S.C. §112, paragraph 6.

Although preferred embodiments of the present invention have been shown and described, various modifications and substitutions may be made thereto without departing from the spirit and scope of the invention. Accordingly, it is to be understood that the present invention has been described by way of illustration and not limitation.

What is claimed is:

1. A disposable toothbrush with toothpaste applicator mechanism comprising;

(a) a multiplicity of bristles;

(b) a plurality of apertures located between the bristles;

(c) a hollow compartment for accommodating a predetermined quantity of toothpaste, the hollow compartment is of quadrilateral cross-section;

(d) a bore connecting the plurality of apertures and the hollow compartment, the bore is of circular cross-section;

(e) a plunger comprising a base, a stem, and a head, the plunger is of quadrilateral cross-section and the cross-sectional area of the stem less than that of the base and the head, wherein the head of the plunger achieves a substantially gapless interface inside the hollow compartment such that the plunger can slide inside the hollow compartment for pushing the toothpaste into the bore and out from the plurality of apertures, wherein the base of the plunger abuts the bottom of the toothbrush when the toothpaste is completely pushed out of the hollow compartment;

(f) the hollow compartment including an opening at its bottom, which receives the stem of the plunger and is adapted to prevent the head of the plunger from being pulled out of the hollow compartment;

(g) a locking member secured over the stem of the plunger for preventing accidental dispensation of the toothpaste before using the toothbrush, the locking member comprises a horizontal panel, two vertical panels projecting perpendicularly from two edges of the horizontal panel, and a catching member located on a free end of the vertical panels that is opposite to the horizontal panel, wherein the inner surface area formed by the horizontal and vertical panels is substantially equal to the outer surface area of the stem of the plunger;

(h) the catching member of the locking member comprising a projection with a right-angled triangular cross-section and comprises an inclined face, a horizontal face and a vertical face, the vertical face in the plane of connection to the vertical panel, wherein the vertical panels of the locking member are resiliently deformed while engaging or disengaging the locking member; and wherein the locking member is removed and the plunger is pushed into the hollow compartment to extract the toothpaste out from the plurality of apertures.

2. The disposable toothbrush with toothpaste applicator mechanism of claim 1, wherein the toothbrush is made of low-cost plastic molding techniques.

3. The disposable toothbrush with toothpaste applicator mechanism of claim 1, wherein the vertical panels are resiliently deformed while slidably engaging or disengaging the locking member.

4. The disposable toothbrush with toothpaste applicator mechanism of claim 1, wherein the toothpaste is contained in a tube, the tube includes an opening, which is connected to the bore.

* * * * *